United States Patent [19]

Buck, Jr. et al.

[11] 3,993,518

[45] Nov. 23, 1976

[54] COTTON BATT AND METHOD FOR PRODUCING SUCH

[76] Inventors: George Sumner Buck, Jr., 4779 Gwynne Road; Robert George Weyker, 64 S. Mendenhall, both of Memphis, Tenn. 38117; Arthur Gerhard Ward, 2788 Madison St., Apt. 3, Memphis, Tenn. 38111

[22] Filed: Sept. 19, 1974

[21] Appl. No.: 507,485

[52] U.S. Cl. ..... 156/62.6; 118/308; 156/62.2; 156/204; 156/283; 264/122; 428/281; 428/283; 428/288

[51] Int. Cl.[2] ..... B32B 31/00

[58] Field of Search ..... 156/62.2, 62.8, 283, 156/320, 62.6, 204; 117/21; 118/308; 161/146, 148, 156, 158, 170, 251; 428/198, 288, 281, 283; 264/122

[56] References Cited

UNITED STATES PATENTS

| | | | |
|---|---|---|---|
| 1,870,041 | 8/1932 | Dike | 156/283 |
| 2,321,082 | 6/1943 | Harshberger | 118/308 |
| 2,671,496 | 3/1954 | Chavannes et al. | 161/249 |
| 2,774,128 | 12/1956 | Secrist | 264/122 |
| 2,808,098 | 10/1957 | Chavannes et al. | 118/308 |
| 2,840,865 | 7/1958 | Reed | 156/62.2 |
| 2,880,113 | 3/1959 | Drelich | 428/288 |
| 2,959,509 | 11/1960 | Marshall | 156/283 |
| 3,287,474 | 11/1966 | Harrington, Jr. | 264/122 |
| 3,619,322 | 11/1971 | Fleissner | 156/62.2 |
| 3,765,971 | 10/1973 | Fleissner | 156/62.2 |

FOREIGN PATENTS OR APPLICATIONS

| | | |
|---|---|---|
| 502,138 | 5/1954 | Canada |

OTHER PUBLICATIONS

Zimmerman & Lavine, Handbook of Material Trade Names, Industrial Research Services, Dover, N.H., 1953 Ed., pp. 503–504.

*Primary Examiner*—George F. Lesmes
*Assistant Examiner*—Charles E. Lipsey
*Attorney, Agent, or Firm*—Littlepage, Quaintance, Murphy & Dobyns

[57] ABSTRACT

A process for producing a cotton batt by forming a thin web of cotton fibers and then contacting the web with particles of a copolymer of vinyl chloride and vinylidene chloride; subsequently forming the web into a batt and then heating the batt.

10 Claims, 4 Drawing Figures

COTTON BATT AND METHOD FOR PRODUCING SUCH

Completely dry processes for forming fibrous batts are known and are described, for example, in Fleissner U.S. Pat. No. 3,765,971. However, prior processes such as those of Fleissner suffer from a number of disadvantages. First, it has been difficult or impossible to uniformly admix the particulate binding agent with the fibers to be bound. This lack of uniform mixing causes a resultant batt of non-uniform strength. Second, prior efforts to identify a practical dry adhesive have been unsuccessful.

It is therefore an object of the present invention to provide an improved method for producing a cotton batt which is substantially free of the disadvantages of the prior art.

Another object is to provide an improved method which produces a batt of high compressive strength.

A further object is to provide an improved method that employs an especially advantageous binding material.

A still further object is to provide an improved cotton batt.

Yet another object is to provide an improved apparatus useful in the production of such batts. Additional objects and advantages of the present invention will be apparent to those skilled in the art by reference to the following detailed description and drawings wherein.

Figure 1:
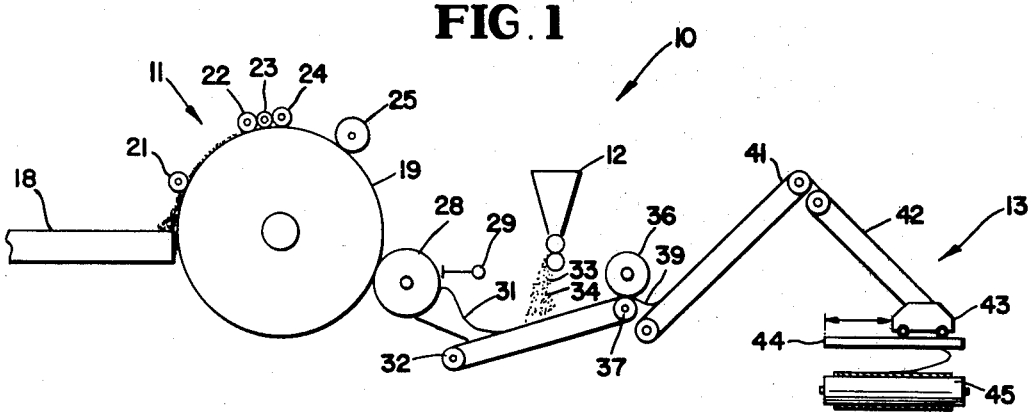
FIG. 1 is an elevation view of an apparatus suitable for practicing the process of the present invention.

The above and other objects are accomplished according to the present invention by providing a process comprising the steps of:

forming a thin web of cotton;

contacting the web with an adhesive amount of particles of a copolymer of vinyl chloride and vinylidene chloride;

forming the web into a batt; and, heating the web to a temperature above the sticking point of the copolymer but below the scorching point of the cotton.

The cotton fibers useful to produce the thin web can be cotton from any source. In fact, the present invention provides a valuable process for employing inexpensive cotton fibers, also referred to as linters or picker-lap. For reasons explained more completely below, the thin web is generally only from 1 to 200 and preferably from 1 to 100 fibers thick.

The copolymer generally has a weight ratio of vinyl chloride to vinylidene chloride of 1:99 to 40:60 and preferably 5:95 to 25:75. At higher ratios, the copolymer exhibits no properties not separately obtained by the use of a homopolymer of vinyl chloride. Likewise, at lower ratios, the use of the copolymer gives no advantages not achieved by the use of pure vinylidene chloride. The copolymer is applied to the web in an amount sufficient to function as an adhesive and generally in a weight ratio of the copolymer to the cotton of 1:99 to 40:60 and preferably 10:90 to 20:80. The copolymer particles generally have a size range of from 1 to 200 and preferably from 20 to 80 microns. Smaller sizes are useful technologically but are expensive to produce. Larger sizes not only unnecessarily increase the weight of the resultant batt but also reduce the number of cross-links possible with a given weight of copolymer which reduces bonding efficiency and strength. Copolymers useful in the present invention have a sticking point of from 300° to 370° F. All copolymers of vinyl chloride and vinylidene chloride useful in the present invention either have this property or can be modified to produce this property according to techniques well known in the art which form no part of the present invention. Copolymers useful in the present invention are available from the Dow Chemical Company, Midland, Michigan, under the following tradenames; Saran Resin XP-5230.04, Saran Resin XP-2384.49, Saran Resin XP-4174.19, Saran Resin XP-5230.05, Saran Resin XP-5230.06, and Saran Resin XP-5230.08.

In the broadest aspects of the present invention any suitable device can be employed to control the rate of addition of the copolymer to the web. However, the rate of addition is generally controlled by the use of a device comprising a container the bottom of which has an opening. Positioned in this opening is a first cylindrical member rotable about its axis. The surface of the first cylindrical member is adapted to adhere to a specific weight of powder per unit area of the surface of the cylindrical member. By controlling the rate of rotation of the cylindrical member, the rate of removal of powder from the container is controlled. The apparatus is also provided with means for removing the copolymer from the surface of the first cylindrical member. The preferred means for doing this is to provide a second cylindrical member the surface of which has bristles adapted to contact the surface of the first cylindrical member and remove copolymer particles therefrom. The apparatus is also provided with means for causing relative movement between the first and second cylindrical members. This relative movement can be caused by rotating the members about their axes in opposite directions. Alternatively, it can be achieved by rotating the first and second cylindrical members in the same direction but at different peripheral rates of speed. The second cylindrical member can be positioned beside the first cylindrical member, below the first cylindrical member, or at any intermediate position. In the preferred embodiment the second cylindrical member is positioned below the first cylindrical member and rotates in an opposite direction.

After the copolymer is contacted with the web, the web is formed into a batt. It is impractical to contact the copolymer with the preformed batt since it is difficult or impossible to insure penetration of the particles into the batt. As used herein, a batt is meant to refer to a plurality of webs.

The batt, formed as described above, is then heated to a temperature above the sticking point of the copolymer but below the scorching point of the cotton and generally at a temperature of 300° to 400° F and preferably at 325° to 375° F. At much lower temperatures, the copolymer does not melt whereas at higher temperatures, the cotton is adversely effected. The heating is conducted for a time sufficient to effect the desired melting of the copolymer which generally occurs within a period of from 1 to 20 minutes. The heating melts the copolymer and the individual fibers of the cotton batt are bonded at their intersection by melted particles. Upon cooling the particles are refrozen.

Figure 2:
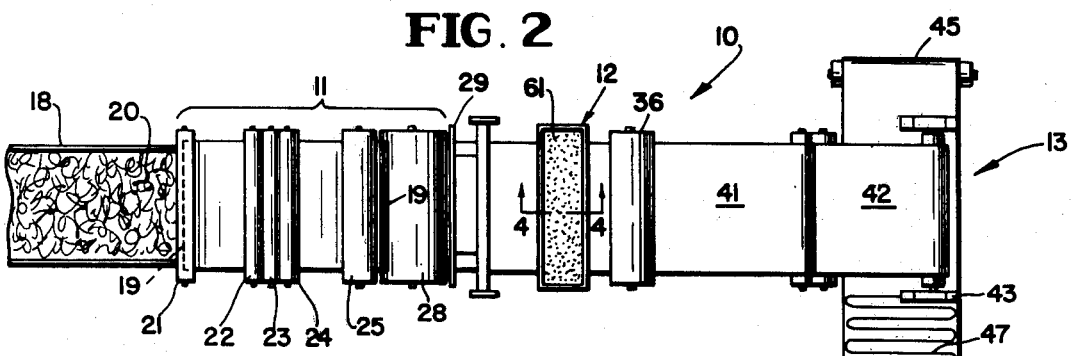
FIG. 2 is a plan view of the apparatus of FIG. 1.
Figure 3:
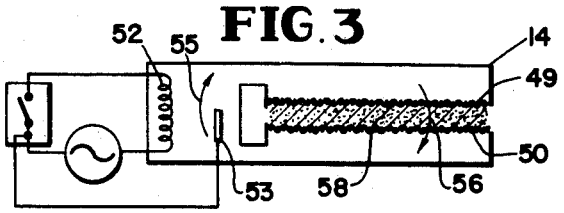
FIG. 3 is a sectional view taken along line 3—3 of FIG. 2.

Referring now to the drawings and in particular to FIG. 1, there is shown an apparatus 10 useful for practicing the process of the present invention. The apparatus 10 comprises an opener or a garnet 11, a particle dispenser 12, a cross-laying mechanism 13 and, as shown in FIG. 2, an oven 14. The garnet 11 comprises an inlet chute 18 adapted to feed bulk cotton to the rotating drum 19 of the garnet 11. The garnet 11 is also provided with a plurality of tooth rolls 21, 22, 23, 24, 25 which together with the teeth not shown on the drum 19 take bulk cotton 20 and convert it to a web which adheres to the drum 19. The web adhering to the drum 19 is transferred to the drum 28 where it is removed by a comb 29. The web 31 that is now only between 1 and 100 fibers thick and is barely self-supporting drops to conveyor 32 where it passes under the particle dispenser 12. While on the conveyor 32 and supported thereby, the web 31 is contacted with particles 33, 34 which fall from the particle dispenser 12 under the influence of gravity. By virtue of the fact that the web 31 is supported on the conveyor 32, the particles 33, 34 do not pass through the web 31 but rather are retained by it. To further insure retention by the web 31 of the particles 33, 34, the web 31 is passed between the nip of two rotating rolls 36, 37; the lower roll 37 performing the dual function of providing a support for the conveyor 32. The web 39 then goes to the conveyor 41 and thence to the conveyor 42. In a manner well known in the art, the lower end of the conveyor 42 is attached to a traveller 43 which moves back and forth on the track 44. The conveyor 42 is positioned above and at right angles to the conveyor 45. The apparatus is adjusted such that the speed of the conveyor 42 is several times faster than the speed of the conveyor 45. By virtue of this arrangement, the web 39 is cross-layed back and forth on the conveyor 45 thus forming an unheat-treated batt 47. The unheat-treated batt 47 passes between an upper foraminous belt 49 and a lower foraminous belt 50 (see FIG. 3). While held between the belts 49, 50, the unheat-treated batt 47 passes into the oven 14. As shown in FIG. 3, the oven 14 is provided with heating means 52 which can be thermostatically controlled by a thermostat 53. The oven 14 is also provided with air circulating means not shown that causes the air to circulate in the direction shown by the arrows 55 and 56. The resultant product is the final heat-treated batt 58.

Figure 4:
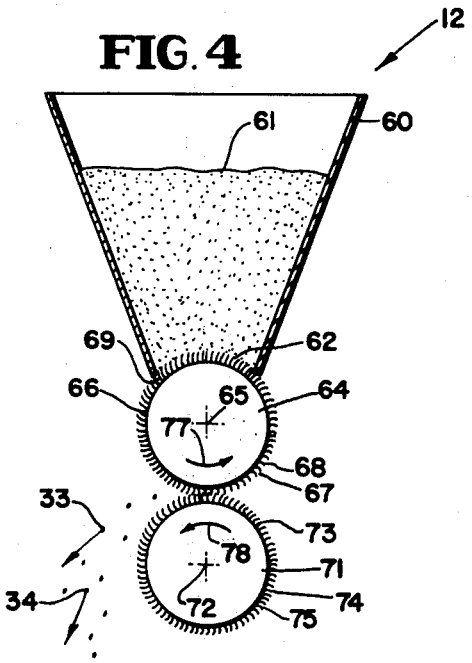
FIG. 4 is a sectional view taken along line 4—4 of FIG. 2.
Figure 4:
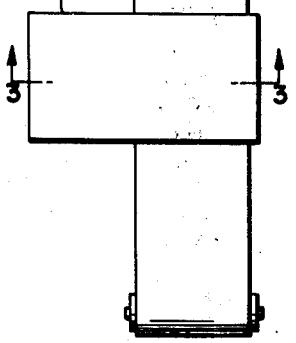

According to another aspect of the present invention, there is provided an improved apparatus for dispensing finely divided particles at a controlled rate. A preferred embodiment of this apparatus is the particle dispenser 12 shown in FIG. 4. The particle dispenser 12 comprises a container 60 containing a quantity 61 of powder. The bottom of the container 60 has an opening 62. In the embodiment shown, the opening is elongated and is adapted to fit snugly to the surface of a first cylindrical member 64. The first cylindrical member 64 is rotatable about its axis 65. The surface 66 of the first cylindrical member 64 is provided with a means to retain the particles, herein a plurality of axially extending fibers 67, 68. The first cylindrical member 64 is positioned below the opening 62 of the container 60 but in contact with the opening 62 in the sense that the surface 66 is out of contact with the rim 69 of the opening 62 but the fibers 67, 68 are at least as long as and preferably longer than the distance between the surface 66 and the rim 69. In this manner, the only particles that can leave the container 60 are those trapped between fibers 67, 68.

The dispenser 12 also has a second cylindrical member 71 rotatable about its axis 72, the axis 72 being parallel to the axis 65. the second cylindrical member 71 may be immediately beneath the first cylindrical member 64, alongside of it or in any intermediary position. In the first instance the cylinders should rotate in the opposite direction. When the second cylindrical member 71 is significantly displaced from vertical alignment, it is desirable to rotate the two cylindrical members in the same direction. The lower cylindrical member 71 will then have to be rotated at a higher linear speed than the upper cylindrical member 64 in order to effect a brushing action. This arrangement directs the flow of particles downwards toward the web. The surface 73 is likewise provided with a plurality of fibers 74, 75. However, the fibers 74, 75 are stiffer than the fibers 67, 68. The difference in stiffness can be imparted to the fibers of the apparatus in any convenient manner, however this stiffness differential is preferably provided by selecting fibers 67, 68 that are small multifilament fibers and selecting fibers 74, 75 which are larger monofilament fibers. The axis 65 of the first cylindrical member 64 is connected to an electric motor not shown which provides means for rotating the first cylindrical member 64 in the direction of the arrow 77. Similarly the axis 72 of the second cylindrical member 71 is attached to an electric motor not shown which provides a means for rotating the second cylindrical member 71 in a direction opposite to that of the first cylindrical member 64 and in the direction of the arrow 78. By virtue of this counter-rotation, the stiffer fibers 74, 75 brush out the particles 33, 34 from between the fibers 67, 68 permitting the particles 33, 34 to fall onto the web 31 (see FIG. 1). If the second cylinder 71 is not beneath the first, but along side or intermediary, then the motor has provision for being driven in the same direction and the particles are also brushed out onto the web.

The surface 66 of the first cylindrical member may be provided with an additional means for retaining a quantity of powder after it rotates past the edge 69 of the hopper. The surface 66 may be knurled, pitted, etched or indented or it may have a coating to which the particles adhere. The first cylindrical member 64 is positioned below the opening of the container 60 but in contact with the opening in the sense that the edge 69 acts as a doctor knife, thereby removing nominally all powder from the roll surface 66. The second cylindrical member 71 has fibers 74, 75 which brush the particles out of the recesses on the surface of the first cylindrical member 64, permitting the particles 33, 34 to fall onto the web 31.

The invention may be understood by reference to the following non-limiting examples. These examples are designed to teach those skilled in the art how to practice the invention and represent the best mode contemplated for practicing the invention. Unless otherwise specified, all parts and percentages are by weight.

EXAMPLE 1

A copolymer of vinyl chloride and vinylidene chloride available from the Dow Chemical Company, Midland, Michigan under the designation XP-5230.04 is added to a cotton web in the manner described above with respect to the drawings. This copolymer has a weight ratio of vinyl chloride to vinylidene chloride of 10:90, a chlorine content of 71%; a plasticizer content of 1%; a minimum particle size of 40 microns and a maximum particle size of 100 microns. The resultant batt has a compressive strength of 63%.

EXAMPLES 2–6

The procedure of Example 1 is repeated except that the copolymer employed in Example 1 is replaced by that copolymer shown in column 2 of the attached table.

TABLE

| (Designation) | Weight Ratio of Vinyl Chloride to Vinylidene Chloride | Chlorine Content (Wt. %) | Plasticizer Content (Wt. %) | Plasticizer Type (Designation) | Stabilizer Content (Wt. %) | Stabilizer Type (Designation) | Minimum Particle Size (μ) | Maximum Particle Size (μ) |
|---|---|---|---|---|---|---|---|---|
| XP-5230.04 | 10/90 | 71 | ≤1% | Citrate | None | — | 40[1] | 100[1] |
| XP-2384.49 | 10/90 | 71 | 6 | Citrate | 2 | Benzophenone | Standard Granulation (Not Micronized) | |
| XP-4174.19 | 15/85 | 70 | ≤1% | Citrate | None | — | Standard Granulation (Not Micronized) | |
| XP-5230.05 | 21/79 | 67 | ≤1% | Citrate | None | — | * | * |
| XP-5230.06 | 15/85 | 69 | ≤1% | Citrate | None | — | ** | ** |
| XP-5230.00 | 7/93 | 72 | 6.0 | Citrate | 1.0 | Epox. Soybean Oil | *** | *** |

Notes
[1]Actual particle size is as follows:
through 60 on 200 mesh (75μ – 250μ) 2%
through 200 on 325 mesh (45μ – 75μ) 77.8%
through 325 mesh (less than 45μ) 20%
* on 100 mesh (greater than 150μ) 14%
thru 100, on 200 mesh (75μ to 150μ) 17%
thru 200, on 325 mesh (45μ to 75μ) 30%
thru 325 mesh (less than 45μ) 39%
** through 200 on 325 mesh (45μ – 75μ) 4%
through 325 mesh (less than 45μ) 96%
*** typical customer audit
over 40 microns - 10% maximum
1–40 microns - 90% minimum
under 1 micron - 10% maximum Although the invention has been described in considerable detail with reference to certain preferred embodiments thereof, it will be understood that variations and modifications can be effected within the spirit and scope of the invention as described above and as defined in the appended claims.

What is claimed is:

1. A dry process for producing a cotton batt of high compressive strength comprising the steps of:

I. forming a thin web of cotton fibers;

II. contacting the web with an adhesive amount of particles of a copolymer of vinyl chloride and vinylidene chloride;

III. forming the web into a batt by laying the web transversely back and forth on a moving belt such that the batt comprises a plurality of webs; and then IV. heating the batt to a temperature above the sticking point of the copolymer but below the scorching point of the cotton wherein the particles have a size range of 20 to 80 microns, wherein the weight ratio of vinyl chloride to vinylidene chloride is 5:95 to 25:75 and wherein the weight ratio of copolymer to the cotton is 10:90 to 20:80.

2. The process of claim 1 wherein the thin web is horizontally disposed.

3. The process of claim 1 wherein the web has a thickness of from 1 to 200 fibers.

4. The process of claim 1 wherein the copolymer has a sticking point of 300° to 370° F.

5. The process of claim 1 wherein the contacting of the web with the particles is effected by feeding the particles from a container into the bristles of a first rotating brush which is then contacted with a counter-rotating brush having stiffer bristles, which remove the particles from the first rotating brush permitting the particles to fall on the web under the influence of gravity.

6. The process of claim 1 wherein the steps are practiced in the order recited.

7. The process of claim 1 wherein the temperature in step IV is between 300° and 400° F.

8. The process of claim 1 wherein the heating is conducted for a period of from 1 to 20 minutes.

9. A completely dry process for producing a cotton batt of high compressive strength comprising in sequence the steps of:

I. forming a horizontally disposed, thin, planar web of waste cotton fibers, said web being from 1 to 100 fibers thick;

II. contacting the web with particles of a copolymer of vinyl chloride and vinylidene chloride while the web is in contact with and supported by a moving belt thereby inhibiting the passage of particles through the web;

A. wherein the copolymer contains 90% vinylidene chloride,

B. wherein the weight ratio of the copolymer to the cotton is 10:90 to 20:80,

C. wherein the copolymer particles have a size range of 20 microns to 80 microns, D. wherein the copolymer has a sticking point of 300° to 370° F, III. passing the web and adhering particles through the nip of two rotating rolls to impress the particles into the web;

IV. forming the web into a batt by laying the web transversely back and forth on moving belt such that the batt comprises a plurality of webs;

V. heating the batt to a temperature of 325° to 375° F for a period of 2 to 10 minutes while the batt is being passed through an oven between two parallel foraminous belts while hot air is forced through the belts and through the batt; thereby producing a cotton batt of high compressive strength.

10. A completely dry process for producing a cotton batt of high compressive strength comprising in sequence the steps of:

I. forming a horizontally disposed, thin, planar web of waste cotton fibers, said web being from 1 to 100 fibers thick;

II. contacting the web with particles of a copolymer of vinyl chloride and vinylidene chloride while the web is in contact with and supported by a moving belt thereby inhibiting the passage of particles through the web;

A. wherein the weight ratio of vinyl chloride to vinylidene chloride is 5:95 to 25:75, B. wherein the weight ratio of the copolymer to the cotton is 10:90 to 20:80, C. wherein the copolymer particles have a size range of 20 microns to 80 microns, D. wherein the copolymer has a sticking point of 300° to 370° F, III. passing the web and adhering particles through the nip of two rotating rolls to impress the particles into the web;

IV. forming the web into a batt by laying the web transversely back and forth on a moving belt such that the batt comprises a plurality of webs;

V. heating the batt to a temperature of 325° to 375° F for a period of 2 to 10 minutes while the batt is being passed through an oven between two parallel foraminous belts while hot air is forced through the belts and through the batt; thereby producing a cotton batt of high compressive strength.

* * * * *